US011037491B1

(12) United States Patent
Lu et al.

(10) Patent No.: US 11,037,491 B1
(45) Date of Patent: Jun. 15, 2021

(54) DISPLAY PANEL AND DISPLAY DEVICE

(71) Applicant: BOE Technology Group Co., Ltd., Beijing (CN)

(72) Inventors: Jiangnan Lu, Beijing (CN); Libin Liu, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 16/830,775

(22) Filed: Mar. 26, 2020

(30) Foreign Application Priority Data

Dec. 10, 2019 (CN) ..... 201911260491.2

(51) Int. Cl.
*G09G 5/10* (2006.01)
*G09G 3/3225* (2016.01)
*G09G 3/3275* (2016.01)

(52) U.S. Cl.
CPC ..... *G09G 3/3225* (2013.01); *G09G 3/3275* (2013.01); *G09G 2300/0426* (2013.01); *G09G 2300/0439* (2013.01)

(58) Field of Classification Search
CPC ..... G06F 3/0412; G06F 2300/04102; G06F 2203/04105; G09G 3/3225; G09G 3/3275; G09G 2300/0426; G09G 2300/0439; G02F 1/134336; G02F 1/136213; G02F 1/13624; G02F 1/136286; H01L 27/1214; H01L 27/124; H01L 27/1255; H01L 27/323
USPC ..... 345/76, 214
See application file for complete search history.

(56) References Cited

U.S. PATENT DOCUMENTS 10,802,630 B2 * 10/2020 Guo ..... H01L 27/1214
2003/0189535 A1 10/2003 Matsumoto et al.
2005/0140605 A1 * 6/2005 Jung ..... G09G 3/3233 345/76

(Continued)

FOREIGN PATENT DOCUMENTS

CN 1658263 A 8/2005
CN 1719508 A 1/2006

(Continued)

OTHER PUBLICATIONS

Office Action for corresponding Chinese Application 201911260491.2 dated Sep. 3, 2020.

*Primary Examiner* — Jennifer T Nguyen
(74) *Attorney, Agent, or Firm* — Arent Fox LLP; Michael Fainberg

(57) ABSTRACT

The disclosure discloses a display panel and a display device. Each data writing circuit includes: a first sub-data writing transistor, a second sub-data writing transistor and a distributed capacitor; a gate of the first sub-data writing transistor and a gate of the second sub-data writing transistor are both electrically connected with a corresponding scanning signal line, a first end of the first sub-data writing transistor is electrically connected with a corresponding data line, a second end of the first sub-data writing transistor is electrically connected with a first end of the second sub-data writing transistor, a second end of the second sub-data writing transistor is electrically connected with a gate of the driving transistor, and a first electrode of the distributed capacitor is electrically connected with the second end of the first sub-data writing transistor, and a second electrode of the distributed capacitor is electrically connected with a fixed voltage signal end.

12 Claims, 8 Drawing Sheets

(56) References Cited

U.S. PATENT DOCUMENTS

| | | | | |
|---|---|---|---|---|
| 2008/0291351 | A1* | 11/2008 | Han | G09G 3/3225 349/48 |
| 2011/0298531 | A1 | 12/2011 | Shah et al. | |
| 2012/0248435 | A1 | 10/2012 | Koyama | |
| 2014/0048812 | A1 | 2/2014 | Nakano et al. | |
| 2015/0123883 | A1* | 5/2015 | Lin | G09G 3/3233 345/76 |
| 2018/0053795 | A1* | 2/2018 | Lan | H01L 27/124 |
| 2019/0123072 | A1 | 4/2019 | Li et al. | |

FOREIGN PATENT DOCUMENTS

| | | | |
|---|---|---|---|
| CN | 102354532 | A | 2/2012 |
| CN | 106886111 | A | 6/2017 |
| CN | 207352947 | A | 5/2018 |
| CN | 110098228 | A | 8/2019 |
| JP | 2009086252 | A | 4/2009 |

* cited by examiner

DISPLAY PANEL AND DISPLAY DEVICE

The present application claims the priority from Chinese Patent Application No. 201911260491.2, filed with the Chinese Patent Office on Dec. 10, 2019, and entitled "DISPLAY PANEL AND DISPLAY DEVICE", which is hereby incorporated by reference in its entirety.

FIELD

The present disclosure relates to the technical field of display, in particular to a display panel and a display device.

BACKGROUND

Organic light emitting diode (OLED) displays are one of the hotspots in the field of research of flat panel displays today. Compared with liquid crystal displays (LCDs), OLED displays have the advantages of being low in energy consumption and production cost, self-luminous, wide in viewing angle, fast in response and the like. Pixel circuits 11 for controlling light emitting devices L to emit light are the core technical content of the OLED displays and are of important research significance.

SUMMARY

The embodiments of the present disclosure provide a display panel. The display panel includes a base substrate, and a plurality of sub-pixels, a plurality of scanning signal lines and a plurality of data lines that are arranged on the base substrate, wherein each row of the sub-pixels corresponds to at least one of the scanning signal lines, each column of the sub-pixels corresponds to at least one of the data lines; each of the sub-pixels includes a pixel circuit; and the pixel circuit includes a data writing circuit and a driving transistor; where the data writing circuit includes: a first sub-data writing transistor, a second sub-data writing transistor and a distributed capacitor; wherein:

a gate of the first sub-data writing transistor and a gate of the second sub-data writing transistor are both electrically connected with a corresponding scanning signal line, a first end of the first sub-data writing transistor is electrically connected with a corresponding data line, a second end of the first sub-data writing transistor is electrically connected with a first end of the second sub-data writing transistor, and a second end of each second sub-data writing transistor is electrically connected with a gate of the driving transistor; and a first electrode of the distributed capacitor is electrically connected with the second end of the first sub-data writing transistor, and a second electrode of the distributed capacitor is electrically connected with a fixed voltage signal end.

Optionally, in the embodiments of the present disclosure, an active layer of the first sub-data writing transistor includes a first source sub-region, a first drain sub-region, and a first channel sub-region arranged between the first source sub-region and the first drain sub-region, where the first source sub-region serves as the first end of the first sub-data writing transistor, and the first drain sub-region serves as the second end of the first sub-data writing transistor;

an active layer of the second sub-data writing transistor includes a second source sub-region, a second drain sub-region, and a second channel sub-region arranged between the second source sub-region and the second drain sub-region, where the second source sub-region serves as the first end of the second sub-data writing transistor, and the second drain sub-region serves as the second end of the second sub-data writing transistor;

the display panel further includes: a conductive portion arranged in each of the sub-pixels, where orthographic projections of at least one of the first drain sub-region and the second source sub-region on the base substrate are overlapped with an orthographic projection of the conductive portion on the base substrate; and the conductive portion serves as the second electrode of the distributed capacitor, and at least one of the first drain sub-region and the second source sub-region overlapped with the conductive portion serve as the first electrode of the distributed capacitor.

Optionally, in the embodiments of the present disclosure, the orthographic projection of the conductive portion on the base substrate and an orthographic projection of the scanning signal line on the base substrate do not overlap.

Optionally, in the embodiments of the present disclosure, the conductive portion includes a first conductive portion; and the display panel further includes: a buffer layer arranged between the active layer of the first sub-data writing transistor and the base substrate; where the first conductive portion is arranged between the buffer layer and the base substrate.

Optionally, in the embodiments of the present disclosure, the conductive portion includes a second conductive portion;

the pixel circuit further includes: a storage capacitor electrically connected with the gate of the driving transistor, where the gate of the driving transistor serves as a first electrode of the storage capacitor, and a second electrode of the storage capacitor is arranged on one side, away from the base substrate, of the gate of the driving transistor; and the second conductive portion and the second electrode of the storage capacitor are arranged on a same layer and insulated.

Optionally, in the embodiments of the present disclosure, the display panel further includes: a plurality of light emitting control signal lines and a first power line; wherein each row of the sub-pixels corresponds to one of the light emitting control signal lines; and the pixel circuit further includes: a light emitting control transistor; where a gate of the light emitting control transistor is electrically connected with a corresponding light emitting control signal line, a first pole of the light emitting control transistor is electrically connected with the first power line, and a second pole of the light emitting control transistor is electrically connected with a first pole of the driving transistor.

Optionally, in the embodiment of the present disclosure, the fixed voltage signal end is electrically connected with the first power line.

Optionally, in the embodiments of the present disclosure, the first power line and the data line are arranged on a same layer and insulated, and the conductive portion and the first power line are arranged on different layers and insulated; and the orthographic projection of the conductive portion on the base substrate and an orthographic projection of the corresponding data line on the base substrate overlap.

Optionally, in the embodiments of the present disclosure, for the scanning signal lines and the light emitting control signal lines corresponding to the same row of the sub-pixels, conductive portions are arranged between the scanning signal lines and the light emitting control signal lines in a direction perpendicular to a plane where the display panel is arranged.

Optionally, in the embodiments of the present disclosure, the display panel further includes: a plurality of reset signal lines and an initialization signal line; and each row of sub-pixels corresponds to one of the reset signal lines; and the pixel circuit further includes a reset transistor, where a gate of the reset transistor is electrically connected with the corresponding reset signal line, a first pole of the reset transistor is electrically connected with the initialization signal line, and a second pole of the reset transistor is electrically connected with a second pole of the driving transistor.

Optionally, in the embodiments of the present disclosure, the fixed voltage signal end is electrically connected with the initialization signal line.

Embodiments of the present disclosure further provide a display device including the above display panels.

DETAILED DESCRIPTION OF THE EMBODIMENTS

Figure 1:
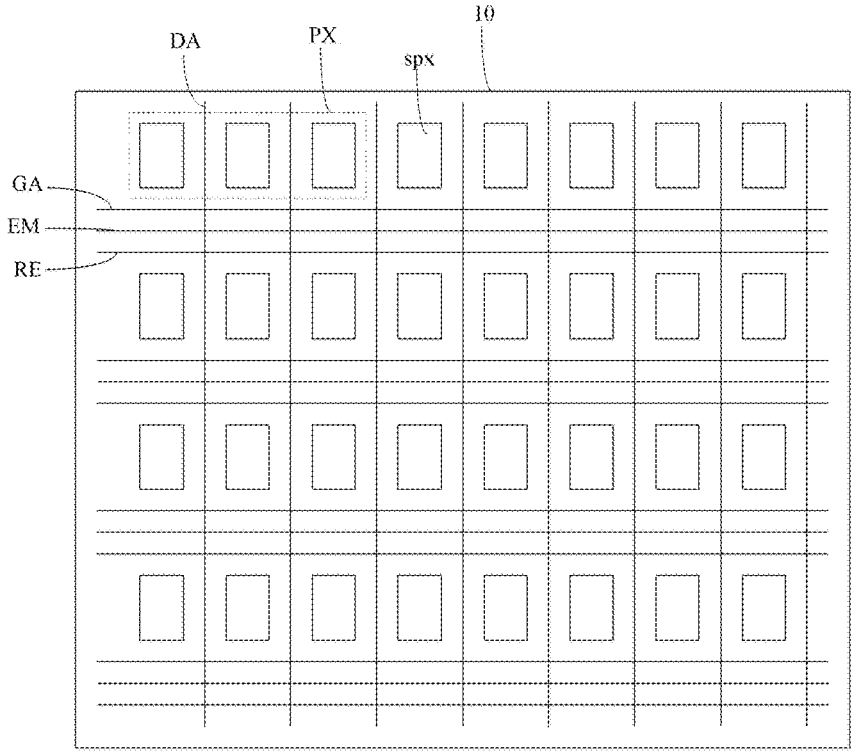
FIG. 1 is a schematic structural diagram of a display panel according to embodiments of the present disclosure.

In order to make the objectives, technical solutions and advantages of the embodiments of the present disclosure clearer, the technical solutions of the embodiments of the present disclosure will be clearly and completely described below with reference to drawings of the embodiments of the present disclosure. Obviously, the described embodiments are a part of embodiments of the present disclosure, but not all the embodiments. The embodiments of the present disclosure and the features in the embodiments may be combined with each other without conflicts. Based on the described embodiments of the present disclosure, all other embodiments obtained by those of ordinary skill in the art without creative labor shall fall within the protection scope of the present disclosure.

Unless otherwise defined, the technical or scientific terms used in the present disclosure shall have the ordinary meanings understood by those with ordinary skills in the field to which the present disclosure belongs. The terms "first", "second" and the like used in the present disclosure do not indicate any order, quantity or importance, but are only used to distinguish different components. Words such as "comprising" or "including" mean that elements or items appearing before the words cover elements or items and the equivalent thereof appearing after the words without excluding other elements or items. Words such as "connection" or "linkage" are not limited to physical or mechanical connection, but may comprise electrical connection, whether direct or indirect.

It should be noted that the sizes and shapes of figures in the drawings do not reflect the true scale, and are only to illustrate the content of the present disclosure. The same or similar reference numerals indicate the same or similar elements or elements with the same or similar functions throughout.

In the related art, pixel circuits 11 for controlling light emitting devices L to emit light are the core technical content of the OLED displays and are of important research significance. However, due to the leakage current characteristic of transistors in the pixel circuits 11, voltages of gates of driving transistors M0 are unstable, and consequently, light emitting is unstable, and the problem of uneven brightness is caused.

Figure 2:
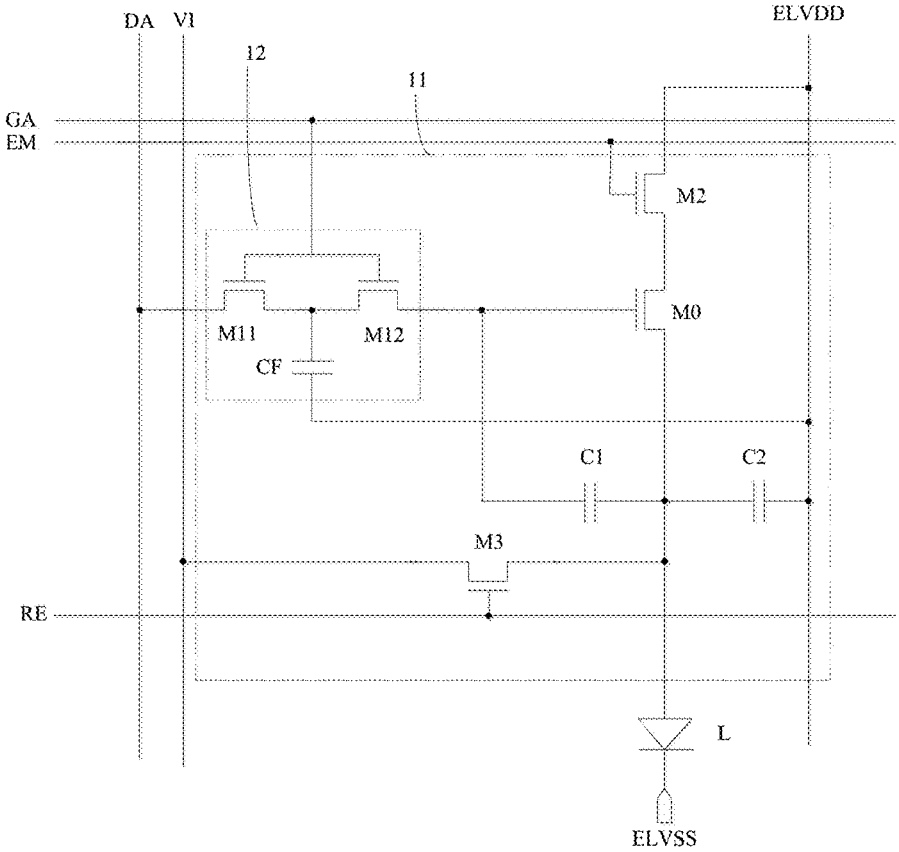
FIG. 2 is a schematic structural diagram of sub-pixels according to embodiments of the present disclosure.

The embodiments of the present disclosure provide a display panel. As shown in FIG. 1 and FIG. 2, the display panel may include: a base substrate 10, a plurality of sub-pixels spx, a plurality of scanning signal lines GA and a plurality of data lines DA, wherein the plurality of sub-pixels spx, the plurality of scanning signal lines GA and the plurality of data lines DA are located on the base substrate 10; each row of the sub-pixels spx corresponds to at least one scanning signal line GA, and each column of the sub-pixels spx corresponds to at least one data line DA; each of the sub-pixels spx includes a pixel circuit 11; the pixel circuit 11 includes a data writing circuit 12 and a driving transistor M0; and the data writing circuit 12 includes a first sub-data writing transistor M11, a second sub-data writing transistor M12 and a distributed capacitor CF;

A gate of the first sub-data writing transistor M11 and a gate of the second sub-data writing transistor M12 are both electrically connected with the corresponding scanning signal line GA, a first end of the first sub-data writing transistor M11 is electrically connected with the corresponding data line DA, a second end of the first sub-data writing transistor M11 is electrically connected with a first end of the second sub-data writing transistor M12, and a second end of the second sub-data writing transistor M12 is electrically connected with a gate of the driving transistor M0;

A first electrode of the distributed capacitor CF is electrically connected with the second end of the first sub-data writing transistor M11, and a second electrode of the distributed capacitor CF is electrically connected with a fixed voltage signal end.

According to the above display panel provided by the embodiment of the present disclosure, each data writing circuit includes the first sub-data writing transistor M11, the second sub-data writing transistor M12 and the distributed capacitor CF, where by arranging the first sub-data writing transistor M11 and the second sub-data writing transistor M12, the lengths L of channel regions of the transistors are increased equivalently, since currents I of the transistors are inversely proportional to the lengths L of the channel regions, the currents I of the transistors may be reduced when the lengths L of the channel regions are increased, and thus leakage currents may be reduced. In addition, by arranging the distributed capacitor CF, the effect of charge storage of the distributed capacitor CF may be adopted for storing the leakage currents of the transistors into the distributed capacitor CF, therefore, voltage differences between the two ends of the first sub-data writing transistor M11 and the second sub-data writing transistor M12 may be reduced, and then the leakage currents are reduced.

It should be noted that in an ideal state, when the transistors are in an off-state, the off-state currents are 0. However, in practical application, the leakage currents exist due to the voltage differences between the first ends and the second ends of the transistors. The larger the voltage differences are, the larger the leakage currents are. According to the display panel provided by the embodiment of the present disclosure, by arranging the distributed capacitor CF, the effect of charge storage of the distributed capacitor CF may be adopted for storing the leakage currents of the transistors into the distributed capacitor CF, therefore, the voltage differences between the first ends and the second ends of the first sub-data writing transistor M11 and the second sub-data writing transistor M12 may be reduced, and then the leakage currents are reduced.

It should be noted that the fixed voltage signal end may be loaded with a voltage signal of a fixed voltage value, thus, the voltage of the second electrode of the distributed capacitor CF may be constant, and the leakage currents may be further reduced.

In specific implementation, in the embodiments of the present disclosure, each sub-pixel spx may further include a light emitting device L. The light emitting device L may include an anode, a light emitting functional layer and a cathode which are stacked. In practical application, a pixel unit PX may include the red sub-pixel, the green sub-pixel and the blue sub-pixel, so that the image display function is achieved by mixing red, green and blue. Each pixel unit PX may also include the red sub-pixel, the green sub-pixel, the blue sub-pixel and the white sub-pixel, so that the image display function is achieved by mixing red, green, blue and white.

In specific implementation, each light emitting device L may include at least one of an OLED and a quantum dot light emitting diode (QLED). When the light emitting device L is the OLED, the anode of the OLED is a first end of the light emitting device L, and the cathode of the OLED is a second end of the light emitting device L. In addition, the light emitting device L generally has light emitting threshold voltage, and emits light when voltage of two ends the light emitting device L is greater than or equal to the light emitting threshold voltage. In practical application, specific structures of the light emitting device L may be designed and determined according to the actual application environment, which is not limited herein.

Figure 4:
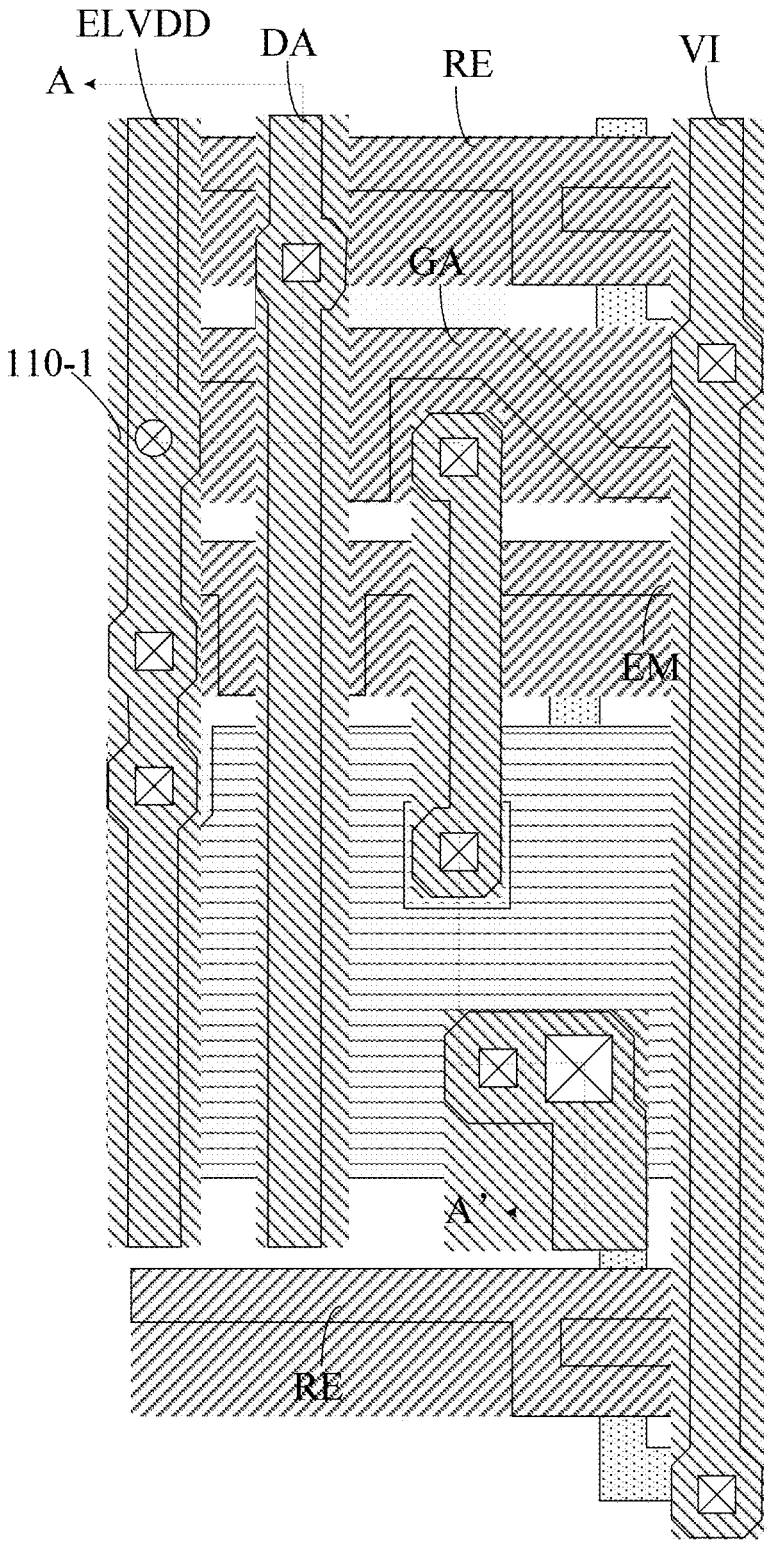
FIG. 4 is a schematic layout diagram of pixel circuits according to embodiments of the present disclosure.

In specific implementation, in the embodiments of the present disclosure, as shown in FIG. 1, FIG. 2 and FIG. 4, the display panel may further include a plurality of light emitting control signal lines EM, a first power line VDD, a plurality of reset signal lines RE and an initialization signal line VI; each row of the sub-pixels spx corresponds to one of the light emitting control signal lines EM; and each row of the sub-pixels spx corresponds to one of the reset signal lines RE.

In specific implementation, in the embodiments of the present disclosure, as shown in FIG. 2, each pixel circuit 11 may further include: a light emitting control transistor M2, a reset transistor M3, a storage capacitor C1, a voltage dividing capacitor C2 and the light emitting device L, where a gate of each light emitting control transistor M2 is electrically connected with the corresponding light emitting control signal line EM, a first pole of each light emitting control transistor M2 is electrically connected with the first power line VDD, and a second pole of each light emitting control transistor M2 is electrically connected with a first pole of the corresponding driving transistor M0.

A gate of each reset transistor M3 is electrically connected with the corresponding reset signal line RE, a first pole of each reset transistor M3 is electrically connected with the initialization signal line VI, and a second pole of each reset transistor M3 is electrically connected with a second pole of the corresponding driving transistor M0.

A first electrode of each storage capacitor C1 is electrically connected with the gate of the corresponding driving transistor M0, and a second electrode of each storage capacitor C1 is electrically connected with the second pole of the corresponding driving transistor M0.

A first electrode of each voltage dividing capacitor C2 is electrically connected with the first power line VDD, and a second electrode of each voltage dividing capacitor C2 is electrically connected with the second pole of the corresponding driving transistor M0.

The second pole of each driving transistor M0 is electrically connected with the first end of the corresponding light emitting device L, and the second end of each light emitting device L is electrically connected with a second power source end.

In specific implementation, the voltage of the first power line VDD may be high, and the voltage of the second power end may be low or the grounding voltage. Certainly, in practical application, specific values of the foregoing voltages may be designed and determined according to the actual application environment, which is not limited herein.

In specific implementation, all the foregoing transistors may be thin film transistors (TFTs) or metal oxide semiconductor field effect transistors (MOSFETs), which are not limited herein. According to the different types of the above-mentioned transistors and the different signals of the gates of the transistors, the first poles of the above-mentioned transistors may serve as sources, and the second poles may serve as drains; or, the first poles of the transistors serve as the drains, and the second poles serve as the sources, which is not specifically distinguished herein.

Figure 3:
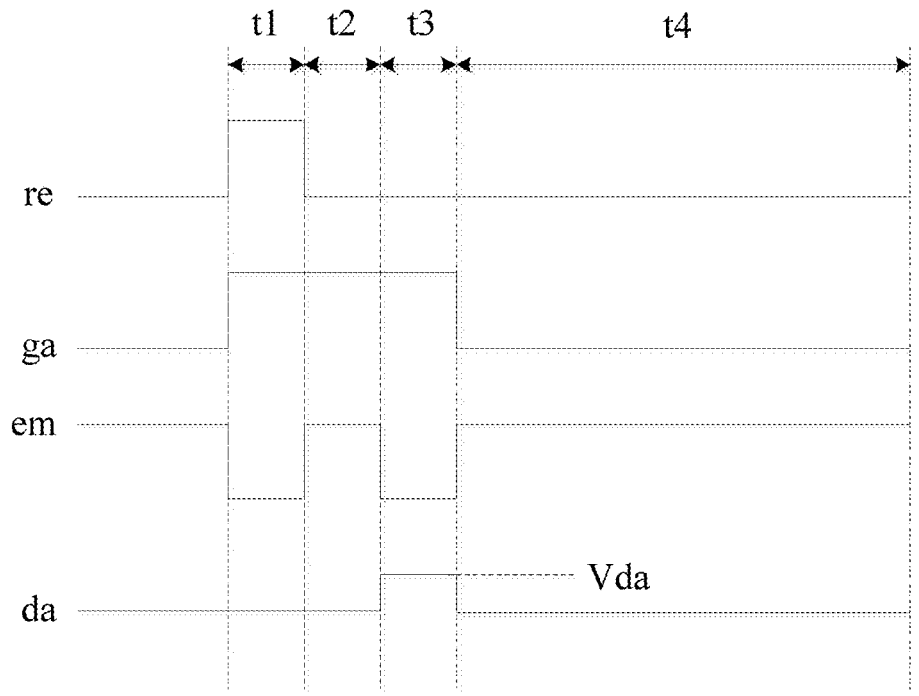
FIG. 3 is a signal timing diagram according to embodiments of the present disclosure.

Referring to the signal timing diagram of pixel circuit 11 shown in FIG. 2, the working process of the pixel circuit is as follows as shown in FIG. 3:

At stage t1, signal em on the light emitting control signal line EM is a low-level signal, so that the light emitting control transistor M2 is turned off. The signal re on the reset signal line RE is a high-level signal, so that the reset transistor M3 is turned on to supply a signal on the initialization signal line VI to the second pole of the driving transistor M0 for initializing the second pole of the driving transistor M0. The signal ga on the scanning signal line GA is a high-level signal, so that the first sub-data writing transistor M11 and the second sub-data writing transistor M12 are turned on, so as to supply the reset voltage signal on the data line DA to the gate of the driving transistor M0 for resetting the gate of the driving transistor M0.

At stage t2, the signal re on the reset signal line RE is a low-level signal, so that the reset transistor M3 is turned off. The signal ga on the scanning signal line GA is a high-level signal, so that the first sub-data writing transistor M11 and the second sub-data writing transistor M12 are turned on, so as to supply the reset voltage signal on the data line DA to the driving transistor M0, and thus the gate voltage of the driving transistor M0 is voltage Vr of the reset voltage signal. The signal em on the light emitting control signal line EM is a high-level signal, so the light emitting control transistor M2 is turned on, so as to charge the second pole of the driving transistor M0, so that the driving transistor M0 is turned off when the voltage of the second pole of the driving transistor M0 becomes Vr+Vth.

At stage t3, the signal re on the reset signal line RE is a low-level signal, so that the reset transistor M3 is turned off. The signal ga on the scanning signal line GA is a high-level signal, so that the first sub-data writing transistor M11 and the second sub-data writing transistor M12 are turned on, so as to supply the data signal on the data line DA to the gate of the driving transistor M0, therefore the gate voltage of the driving transistor M0 is the voltage Vd of the data signal. Through the functions of the storage capacitor C1 and the voltage dividing capacitor C2, the second pole of the driving transistor M0 becomes:

$$\frac{c1}{c1+c2}(Vd-Vr)+Vr+Vth,$$

where, c1 represents the capacitance value of stored electricity, c2 represents the capacitance value of the voltage dividing capacitor C2, and Vth represents the threshold voltage of the driving transistor M0.

At stage t4, the signal re on the reset signal line RE is a low-level signal, so that the reset transistor M3 is turned off. The signal ga on the scanning signal line GA is a low-level signal, so that the first sub-data writing transistor M11 and the second sub-data writing transistor M12 are turned off. The signal em on the light emitting control signal line EM is a high-level signal, so that the light emitting control transistor M2 is turned on, then the driving transistor M0 is enabled to generate currents IL so as to drive light emitting device LL to emit light through the currents IL, and $$IL=K\left[\frac{c1}{c1+c2}(Vd-Vr)+Vr\right]^2,$$

where, K represents a structural parameter. In addition, due to the distributed capacitor, the leakage currents of the transistors may be stored in the distributed capacitor CF, so that the voltage differences between the two ends of the first sub-data writing transistor M11 and the second sub-data writing transistor M12 may be reduced, and therefore the leakage currents are reduced.

Figure 5:
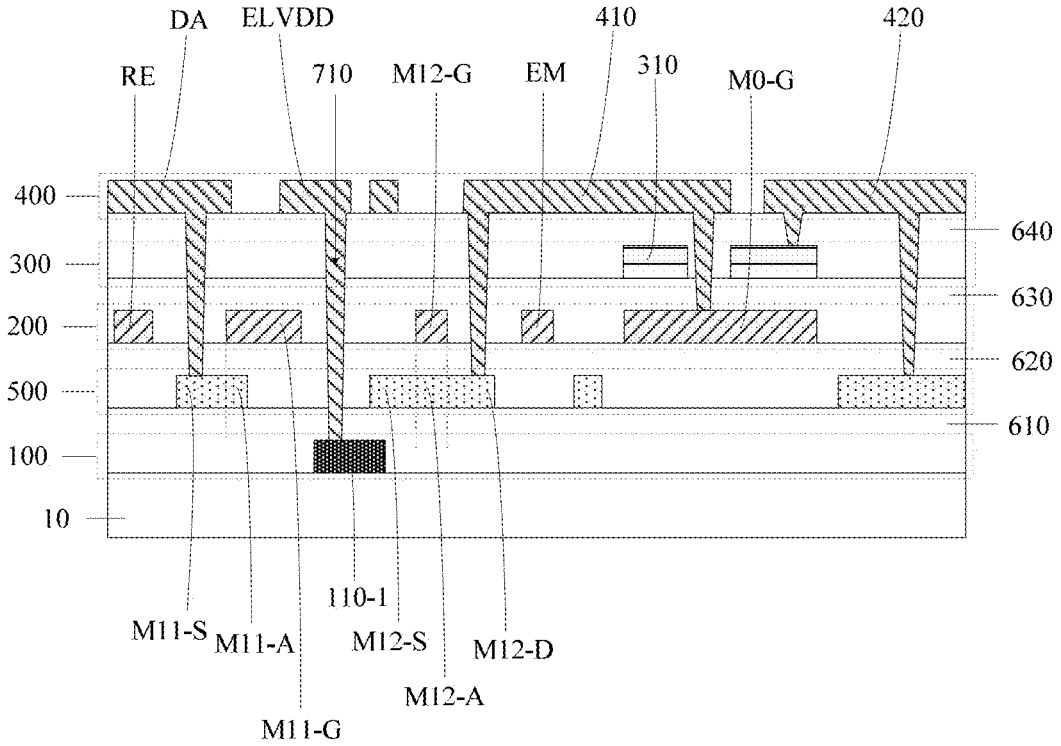
FIG. 5 is a sectional structural view in the AA' direction of the schematic layout diagram in FIG. 4 according to embodiments of the present disclosure.

FIG. 4 is a schematic layout diagram of the above pixel circuit 11 on the base substrate 10. FIG. 5 is a sectional structural view in the AA' direction of the schematic layout diagram shown in FIG. 4.

FIG. 4 and FIG. 5 illustrate the stacked positional relationship of a first conductive layer 100, an active semiconductor layer 500, a second conductive layer 200, a third conductive layer 300 and a fourth conductive layer 400 in the above pixel circuit 11. In addition, it should be noted that the display panel may further include: a buffer layer 610 located between the first conductive layer 100 and the active semiconductor layer 500, a gate insulating layer 620 located between the active semiconductor layer 500 and the second conductive layer 200, an interlayer dielectric layer 630 located between the second conductive layer 200 and the third conductive layer 300, and an interlayer insulation layer 640 located between the third conductive layer 300 and the fourth conductive layer 400. The buffer layer 610 may insulate the first conductive layer 100 from the active layer of the first sub-data writing transistor M11 and the active layer of the second sub-data writing transistor M12.

In specific implementation, in the embodiments of the present disclosure, as shown in FIG. 4 and FIG. 5, the active semiconductor layer 500 may be formed by patterning the semiconductor material. The active semiconductor layer 500 may be used for making the active layers of the above-mentioned transistors. Each active layer may include a source region, a drain region and a channel region located between the source region and the drain region. For example, the active layer of each first sub-data writing transistor M11 may include a first source sub-region, a first drain sub-region and a first channel sub-region located between the first source sub-region and the first drain sub-region, where each first source sub-region serves as the first end of each first sub-data writing transistor M11, and each first drain sub-region serves as the second end of each first sub-data writing transistor M11. The active layer of each second sub data writing transistor M12 includes a second source sub-region, a second drain sub-region and a second channel sub-region located between the second source sub-region and the second drain sub-region, where each second source sub-region serves as the first end of each second sub-data writing transistor M12, and each second drain sub-region serves as the second end of each second sub-data writing transistor M12. FIG. 4 shows the first source sub-region M11-S and the first channel sub-region M11-A of each first sub-data writing transistor M11, and the second source sub-region M12-S, the second channel sub-region M12-A and the second drain sub-region M12-D of each second sub-data writing transistor M12.

Exemplarily, the active layers of a part of the transistors may be arranged integrally. Exemplarily, the active semiconductor layer 500 may be made of amorphous silicon, polysilicon, an oxide semiconductor material or the like. It should be noted that the above-mentioned source regions and drain regions may be regions doped with n-type impurities or p-type impurities.

In specific implementation, in the embodiments of the present disclosure, as shown in FIGS. 4 and 5, the second conductive layer 200 may include the scanning signal lines GA, the light emitting control signal lines EM, the reset signal lines RE, the initialization signal line VI, the gates of all the transistors in the above-mentioned pixel circuits 11, the first electrodes of the storage capacitors C1 and the first electrodes of the voltage dividing capacitors C2. For example, FIGS. 4 and 5 show the reset signal lines RE, the light emitting control signal lines EM, the gates M11-G of the first sub-data writing transistors M11, the gates M12-G of the second sub-data writing transistors M12 and the gates M0-G of the driving transistors M0. In addition, the gate M0-G of the driving transistor M0 may serve as the first electrode of the storage capacitor C1. The scanning signal lines GA, the light emitting control signal lines EM, the reset signal lines RE and the active semiconductor layer 500 have overlapping areas in the direction perpendicular to the plane on which the base substrate 10 is located. For the overlapping areas of the scanning signal lines GA and the active semiconductor layer 500, the scanning signal lines GA in the overlapping areas may serve as the gates M11-G of the first sub-data writing transistors M11 and the gates M12-G of the second sub-data writing transistors M12, and the active semiconductor layer 500 in the overlap areas may serve as the channel regions M11-A of the first sub-data writing transistors M11 and the channel regions M12-A of the second sub-data writing transistors M12. The rest arrangement is the same and will not be repeated herein.

In specific implementation, in the embodiments of the present disclosure, as shown in FIG. 4 and FIG. 5, the third conductive layer 300 may include: an electrode conductive layer 310. The electrode conductive layer 310 serves as the second electrode C1-2 of the storage capacitor C1 and the second electrode of the voltage dividing capacitor C2. That is, the second electrode C1-2 of the storage capacitor C1 and the second electrode of the voltage dividing capacitor C2 are of an integrated structure, and the second electrode of the storage capacitor C1 is located on the side, away from the base substrate 10, of the gate of the driving transistor M0.

In specific implementation, in the embodiments of the present disclosure, as shown in FIG. 4 and FIG. 5, the fourth conductive layer 400 may include: the data lines DA, the first power line VDD, the initialization signal line VI, a connecting portion and an anode connecting layer, where the connecting portion and the anode connecting layer are used for electrically connecting the above transistors, the storage capacitors C1 and the voltage dividing capacitors C2. For example, FIGS. 4 and 5 show the data lines DA, the first power line VDD, the initialization signal line VI, the connecting portion 410 and the anode connecting layer 420, where the connecting portion 410 and the anode connecting layer 420 electrically connect each second sub-data writing transistor M12 with the gate M0-G of the driving transistor M0. One end of the connecting portion 410 penetrates through via holes of the gate insulation layer 620, the interlayer dielectric layer 630 and the interlayer insulation layer 640 to be electrically connected with the second drain regions M12-D of the second sub-data writing transistors M12, and the other end of the connecting portion 410 penetrates through the via holes of the interlayer dielectric layer 630 and the interlayer insulation layer 640 to be electrically connected with the gates M0-G of the driving transistors M0. One end of the anode connecting layer 420 penetrates through the via hole of the interlayer insulation layer 640 to be electrically connected with the second electrodes of the storage capacitors C1, and one end of the anode connecting layer 420 penetrates through the via holes of the gate insulation layer 620, the interlayer dielectric layer 630 and the interlayer insulation layer 640 to be electrically connected with the source regions of the driving transistors M0.

In specific implementation, in the embodiments of the present disclosure, the display panel may further includes: conductive portions located in the sub-pixels spx. All the conductive portions are arranged at intervals. In addition, orthographic projections of at least one of the first drain sub-region and the second source sub-region on the base substrate 10 and the orthographic projection of the conductive portion on the base substrate 10 have overlapping regions. Moreover, the conductive portion serves as the second electrode of the distributed capacitor CF, and at least one of the first drain sub-region and the second source sub-region having the overlapping regions with the conductive portion serve as the first electrode of the distributed capacitor CF. Further, the conductive portions are insulated from the active layers of the transistors.

In specific implementation, in the embodiments of the present disclosure, the orthographic projections of the conductive portions on the base substrate 10 and the orthographic projections of the scanning signal lines GA on the base substrate 10 do not overlap. In this way, the conductive portions may be prevented from interfering the signals on the scanning signal lines GA.

In specific implementation, in the embodiments of the present disclosure, as shown in FIGS. 4 and 5, the display panel may further include the first conductive layer 100 located between the buffer layer 610 and the base substrate 10. The conductive portion includes a first conductive portion 110-1; and all the first conductive portions 110-1 are located on the first conductive layer 100. For example, FIGS. 4 and 5 show a first conductive portion 110-1.

In specific implementation, in the embodiments of the present disclosure, as shown in FIG. 4 and FIG. 5, orthographic projections of at least one of the first drain sub-region and the second source sub-region M12-S on the base substrate 10 and orthographic projection of the first conductive portion 110-1 on the base substrate 10 have overlapping regions. The first conductive portion 110-1 may serve as the second electrode of the distributed capacitor CF, and at least one of the first drain sub-region and the second source sub-region having the overlapping regions with the first conductive portion 110-1 serve as the first electrode of the distributed capacitor CF. In addition, the first conductive portion 110-1 is electrically connected with the fixed voltage signal end. Exemplarily, the first drain sub-region and the second source sub-region M12-S are of an integrated structure, and the orthographic projections of the first drain sub-region and the second source sub-region M12-S on the base substrate 10 both overlap with the orthographic projection of the first conductive portion 110-1 on the base substrate 10. Then, the first conductive portion 110-1 may serve as the second electrode of the distributed capacitor CF, and the first drain sub-region and the second source sub-region M12-S having the overlapping regions with the first conductive portion 110-1 may serve as the first electrode of the distributed capacitor CF.

In specific implementation, in the embodiments of the present disclosure, as shown in FIGS. 4 and 5, the orthographic projections of the first conductive portions 110-1 on the base substrate 10 and the orthographic projections of the scanning signal lines GA on the base substrate 10 do not overlap.

It should be noted that the fixed voltage signal end is electrically connected with the first conductive portion 110-1 so as to load the voltage signal of the fixed voltage value to the first conductive portion 110-1.

Exemplary, the fixed voltage signal end may be electrically connected with the first power line VDD. For example, as shown in FIGS. 4 and 5, the first power line VDD penetrates through the via holes 710 of the buffer layer 610, the gate insulation layer 620, the interlayer dielectric layer 630 and the interlayer insulation layer 640 to be electrically connected with the first conductive portion 110-1, so that the voltage transmitted on the first power line VDD is loaded on the first conductive portion 110-1. Alternatively, the fixed voltage signal end may be electrically connected with the initialization signal line VI, so that the first conductive portion 110-1 is loaded with the voltage transmitted on the initialization signal line VI.

In specific implementation, in the embodiments of the present disclosure, as shown in FIGS. 4 and 5, the first power line VDD and the data lines DA are arranged on the same layer and arranged in the fourth conductive layer 400 in an insulated mode. In addition, the conductive portion is insulated from the first power line VDD in different layers. Moreover, the orthographic projections of the conductive portions on the base substrate 10 and the orthographic projections of the corresponding data lines DA on the base substrate 10 have the overlapping areas. For example, the first conductive portions 110-1 are located in the first conductive layer 100. The orthographic projections of the first conductive portions 110-1 on the base substrate 10 and the orthographic projections of the corresponding data lines DA on the base substrate 10 have the overlapping areas.

In specific implementation, in the embodiments of the present disclosure, as shown in FIG. 4 and FIG. 5, for the scanning signal lines GA and the light emitting control signal lines EM corresponding to the same row of the sub-pixels spx, in the direction perpendicular to the plane where the display panel is located, the conductive portions are located between the scanning signal lines GA and the light emitting control signal lines EM. For example, for the scanning signal lines GA and the emitting control signal lines EM corresponding to the same row of the sub-pixels spx, in the direction perpendicular to the plane where the display panel is located, the first conductive portions 110-1 are located between the scanning signal lines GA and the light emitting control signal lines EM.

Figure 6:
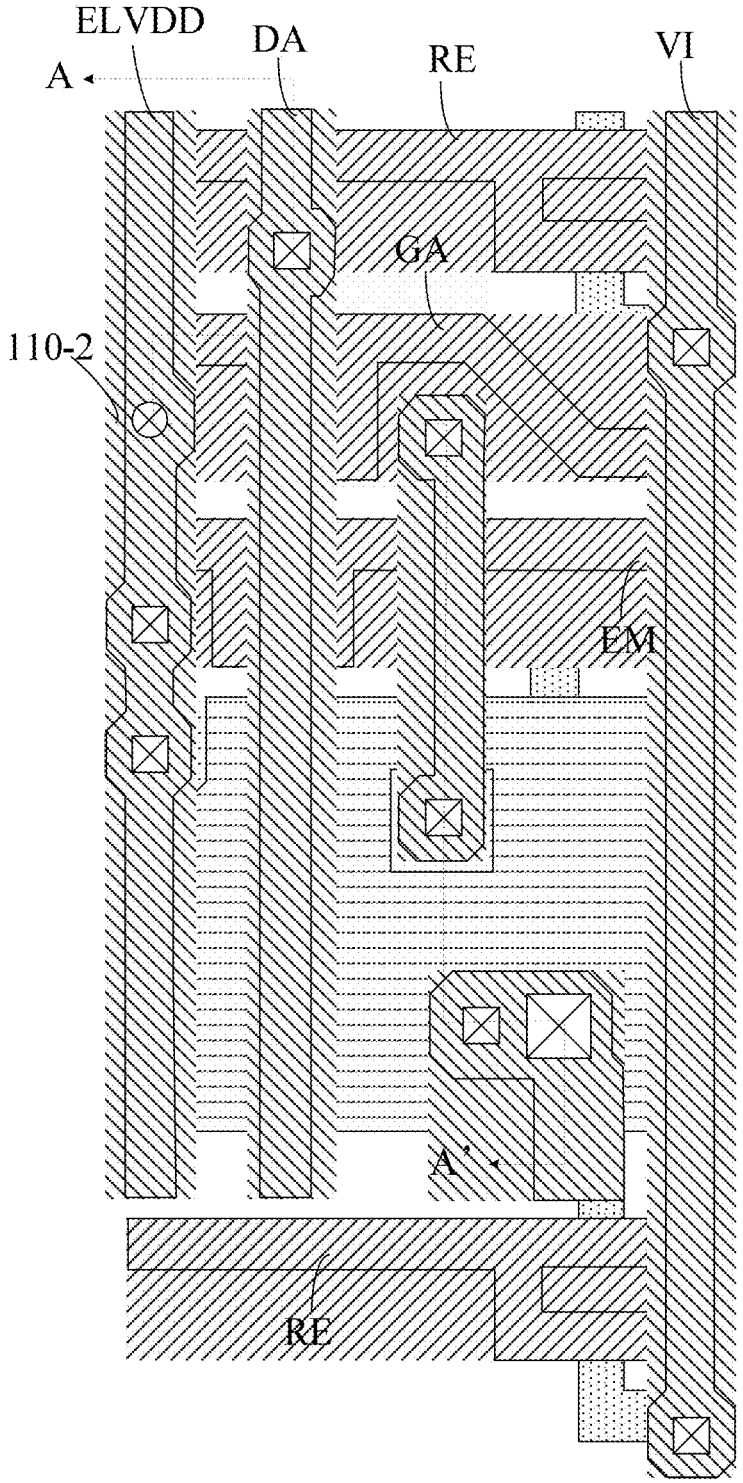
FIG. 6 is a schematic layout diagram of the pixel circuits according to embodiments of the present disclosure.
Figure 7:
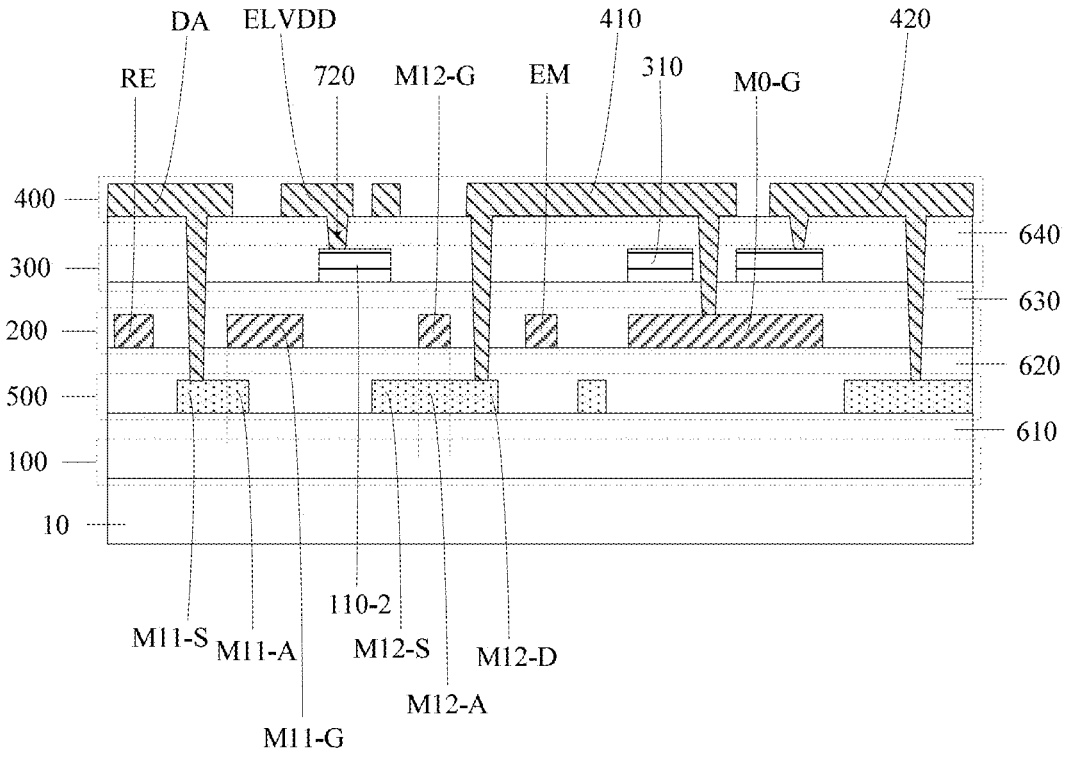
FIG. 7 is a sectional structural view in the AA' direction of the schematic layout diagram in FIG. 6 according to embodiments of the present disclosure.

Embodiments of the present disclosure further provide some display panels, the schematic structural diagrams of the display panels are shown in FIG. 6 and FIG. 7, and the display panels are deformed according to implementations of the foregoing embodiments. The following describes only the differences between the embodiment and the above embodiments, and the similarities are not described herein.

In specific implementation, in the embodiments of the present disclosure, the conductive portion includes the second conductive portion 110-2, and the second conductive portion 110-2 and the second electrode of the storage capacitor C1 are arranged on the same layer and insulated. For example, as shown in FIGS. 6 and 7, the second conductive portion 110-2 is located on the third conductive layer 300, and the second conductive portion 110-2 is insulated from the electrode conductive layer 310.

In specific implementation, in the embodiments of the present disclosure, as shown in FIGS. 6 and 7, the orthographic projection of the second conductive portion 110-2 on the base substrate 10 and the orthographic projection of the scanning signal line GA on the base substrate 10 do not overlap.

Exemplary, the fixed voltage signal end may be electrically connected with the first power line VDD. For example, as shown in FIGS. 6 and 7, the first power line VDD is electrically connected with the second conductive portion 110-2 by penetrating through the via hole 720 of the interlayer insulating layer 640, so that the second conductive portion 110-2 is loaded with the voltage transmitted on the first power line VDD. Alternatively, the fixed voltage signal end may be electrically connected with the initialization signal line VI, so that the voltage transmitted on the initialization signal line VI is loaded on the second conductive portion 110-2.

In specific implementation, in the embodiments of the present disclosure, as shown in FIGS. 6 and 7, the orthographic projection of the second conductive portion 110-2 on the base substrate 10 and the orthographic projection of the corresponding data line DA on the base substrate 10 have overlapping areas.

In specific implementation, in the embodiments of the present disclosure, as shown in FIG. 6 and FIG. 7, for the scanning signal lines GA and the light emitting control signal lines EM corresponding to the same row of sub-pixels spx in the direction perpendicular to the plane where the display panel is located, the second conductive portions 110-2 are located between the scanning signal lines GA and the light emitting control signal lines EM.

Figure 8:
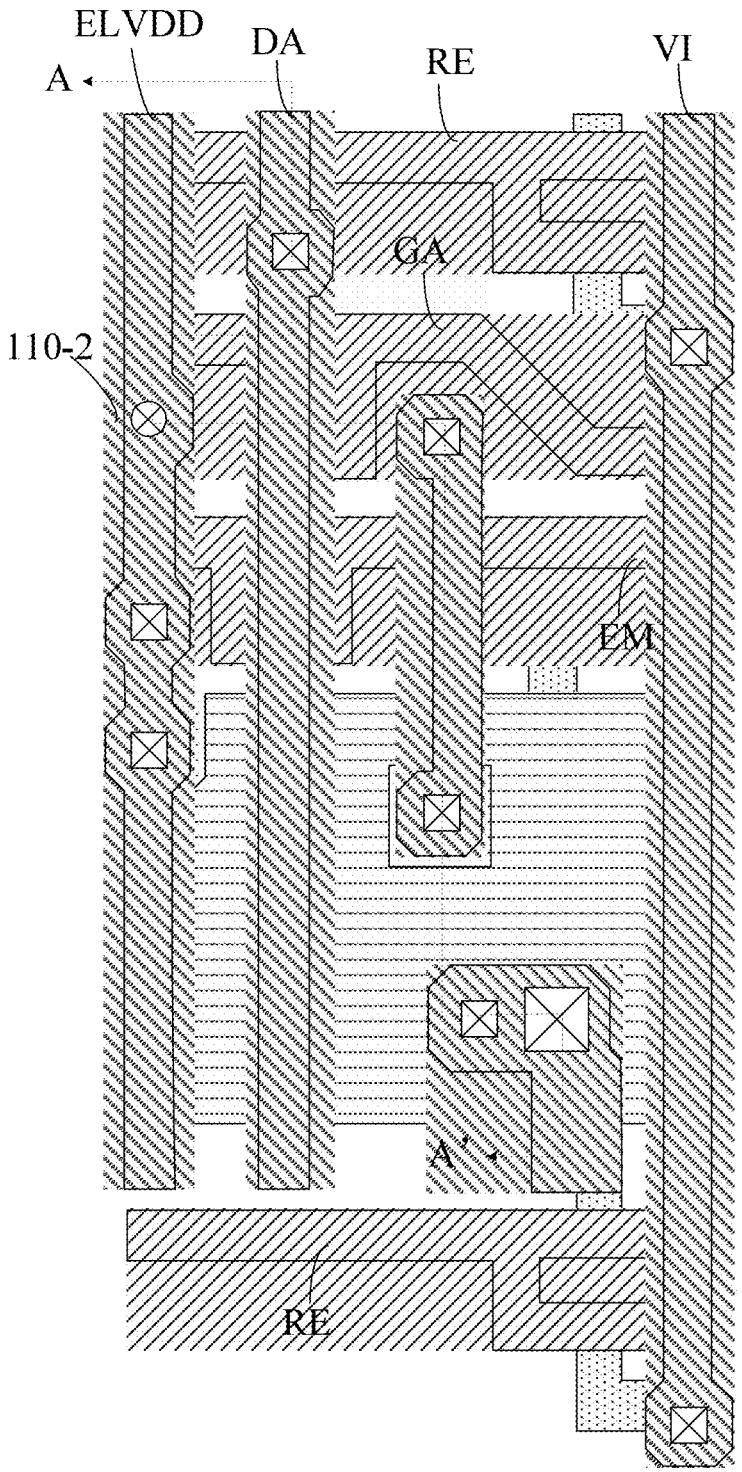
FIG. 8 is a schematic layout diagram of the pixel circuits according to embodiments of the present disclosure.
Figure 9:
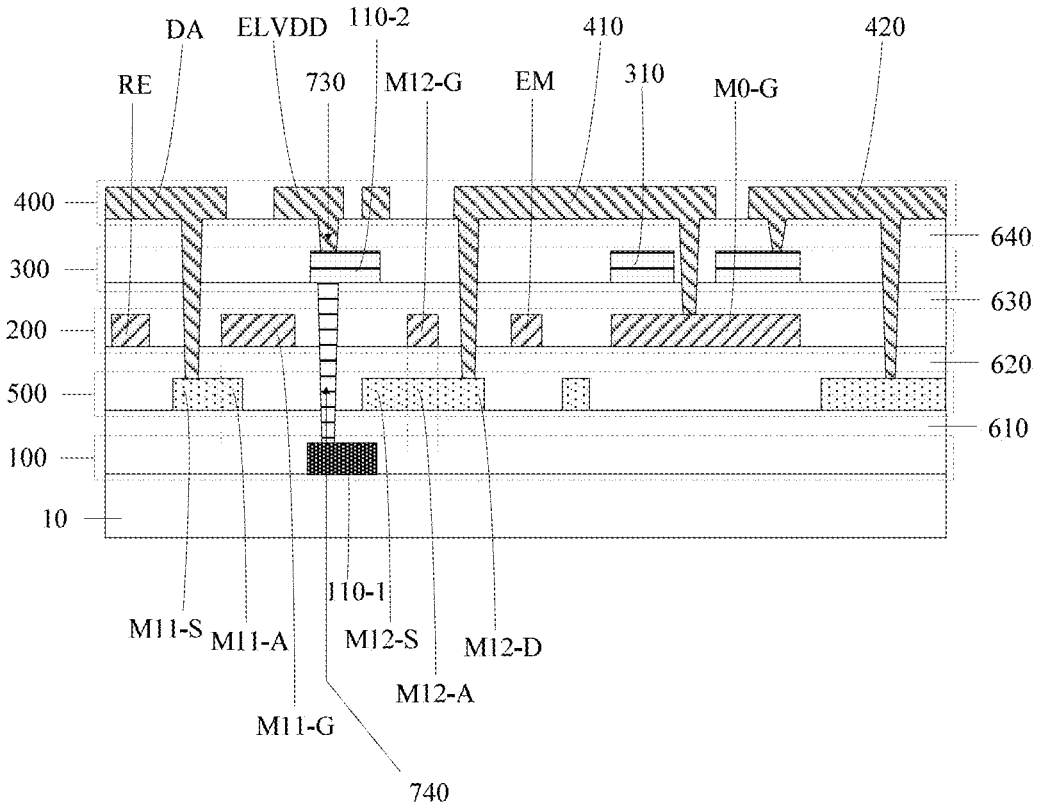
FIG. 9 is a sectional structural view in the AA' direction of the schematic layout diagram in FIG. 8 according to embodiments of the present disclosure.

Embodiments of the present disclosure further provide some display panels. The schematic structural diagrams of the display panels are shown in FIG. 8 and FIG. 9, and the display panels are deformed according to the implementations of the foregoing embodiments. The following describes only the differences between the embodiment and the above embodiments, and the similarities are not described herein.

In specific implementation, in the embodiments of the present disclosure, the conductive portion include the first conductive portion 110-1 and the second conductive portion 110-2. For example, as shown in FIGS. 8 and 9, all the first conductive portions 110-1 are located on the first conductive layer 100. The second conductive portions 110-2 are located on the third conductive layer 300, and the second conductive portions 110-2 are insulated from the electrode conductive layer 310.

In specific implementation, in the embodiments of the present disclosure, as shown in FIG. 8 and FIG. 9, the orthographic projections of the first conductive portion 110-1 and the second conductive portion 110-2 on the base substrate 10 and the orthographic projection of the scanning signal line GA on the base substrate 10 do not overlap.

Exemplary, the fixed voltage signal end may be electrically connected with the first power line VDD. For example, as shown in FIG. 8 and FIG. 9, the first power line VDD is electrically connected with the second conductive portion 110-2 by penetrating through the via hole 730 of the interlayer insulating layer 640, and the second conductive portion 110-2 penetrates through the via holes 740 of the buffer layer 610, the gate insulating layer 620 and the interlayer dielectric layer 630 to be electrically connected with the first conductive portion 110-1, so that the first conductive portion 110-1 and the second conductive portion 110-2 are loaded with the voltage transmitted on the first power line VDD. Alternatively, the fixed voltage signal end may be electrically connected with the initialization signal line VI, so that the voltage transmitted on the initialization signal line VI is loaded on the first conductive portion 110-1 and the second conductive portion 110-2.

In specific implementation, in the embodiments of the present disclosure, as shown in FIGS. 8 and 9, the orthographic projections of the first conductive portion 110-1 and the second conductive portion 110-2 on the base substrate 10 and the orthographic projection of the corresponding data line DA on the base substrate 10 have the overlapping areas.

In specific implementation, in the embodiments of the present disclosure, as shown in FIG. 8 and FIG. 9, for the scanning signal lines GA and the light emitting control signal lines EM corresponding to the same row of sub-pixels spx, in the direction perpendicular to the plane where the display panel is located, the first conductive portions 110-1 and the second conductive portions 110-2 are located between the scanning signal lines GA and the light emitting control signal lines EM.

Based on the same inventive concept, the embodiment of the present disclosure further provides a display device, the display device includes the display panel provided by the embodiments of the present disclosure. The principle of the display device for solving the problem is similar to that of the foregoing display panel. Therefore, implementation of the display device may refer to the implementation of the foregoing display panel, and repetition is not described herein.

In specific implementation, in the embodiments of the present disclosure, the display device may be any product or component with a display function, such as a mobile phone, a tablet computer, a television, a display, a notebook computer, a digital photo frame and a navigator. Other essential components of the display device are understood by those of ordinary skill in the art, which will not be repeated herein and should not be used as a limitation on the present disclosure.

According to the display panel and the display device provided by the embodiments of the present disclosure, each data writing circuit includes: the first sub-data writing transistor, the second sub-data writing transistor and the distributed capacitor, where by arranging the first sub-data writing transistor and the second sub-data writing transistor, the lengths of the channel regions of the transistors are increased equivalently, since the currents of the transistors are inversely proportional to the lengths of the channel regions, the currents of the transistors may be reduced when the lengths of the channel regions are increased, and thus the leakage currents may be reduced. In addition, by arranging the distributed capacitor, the effect of charge storage of the distributed capacitor may be adopted for storing the leakage currents of the transistors into the distributed capacitor, therefore, the voltage differences between the two ends of the first sub-data writing transistor and the second sub-data writing transistor may be reduced, and then the leakage currents are reduced.

Obviously, those skilled in the art may make various modifications and variations to the present disclosure without departing from the spirit and scope of the present disclosure. In this way, if these modifications and variations of the present disclosure fall within the scope of the claims of the present disclosure and the equivalent technologies, the present disclosure also intends to include these modifications and variations.

What is claimed is:

1. A display panel, comprising:

a base substrate; and a plurality of sub-pixels, a plurality of scanning signal lines and a plurality of data lines that are arranged on the base substrate;

wherein:

each row of sub-pixels corresponds to at least one of the scanning signal lines;

each column of sub-pixels corresponds to at least one of the data lines;

each of the sub-pixels comprises a pixel circuit; and the pixel circuit comprises:

a data writing circuit; and a driving transistor;

wherein the data writing circuit comprises:

a first sub-data writing transistor;

a second sub-data writing transistor; and a distributed capacitor;

wherein:

a gate of the first sub-data writing transistor and a gate of the second sub-data writing transistor are both electrically connected with a corresponding scanning signal line;

a first end of the first sub-data writing transistor is electrically connected with a corresponding data line;

a second end of the first sub-data writing transistor is electrically connected with a first end of the second sub-data writing transistor;

a second end of the second sub-data writing transistor is electrically connected with a gate of the driving transistor; and a first electrode of the distributed capacitor is electrically connected with the second end of the first sub-data writing transistor; and a second electrode of the distributed capacitor is electrically connected with a fixed voltage signal end;

wherein:

an active layer of the first sub-data writing transistor comprises:

a first source sub-region;

a first drain sub-region; and a first channel sub-region arranged between the first source sub-region and the first drain sub-region;

an active layer of the second sub-data writing transistor comprises:

a second source sub-region;

a second drain sub-region; and a second channel sub-region arranged between the second source sub-region and the second drain sub-region; and the display panel further comprises:

a conductive portion arranged in each of the sub-pixels;

wherein:

orthographic projections of at least one of the first drain sub-region and the second source sub-region on the base substrate are overlapped with an orthographic projection of the conductive portion on the base substrate;

the conductive portion serves as the second electrode of the distributed capacitor, and at least one of the first drain sub-region and the second source sub-region overlapped with the conductive portion serve as the first electrode of the distributed capacitor; and the orthographic projection of the conductive portion on the base substrate is overlapped with an orthographic projection of the corresponding data line on the base substrate.

2. The display panel according to claim 1, wherein:

the first source sub-region serves as the first end of the first sub-data writing transistor; and the first drain sub-region serves as the second end of the first sub-data writing transistor;

wherein:

the second source sub-region serves as the first end of the second sub-data writing transistor; and the second drain sub-region serves as the second end of the second sub-data writing transistor.

3. The display panel according to claim 1, wherein the orthographic projection of the conductive portion on the base substrate and an orthographic projection of the scanning signal line on the base substrate do not overlap.

4. The display panel according to claim 1, wherein the conductive portion comprises:

a first conductive portion; and the display panel further comprises:

a buffer layer arranged between the active layer of the first sub-data writing transistor and the base substrate;

wherein the first conductive portion is arranged between the buffer layer and the base substrate.

5. The display panel according to claim 1, wherein the conductive portion comprises:

a second conductive portion;

the pixel circuit further comprises:

a storage capacitor electrically connected with the gate of the driving transistor;

wherein the gate of the driving transistor serves as a first electrode of the storage capacitor, and a second electrode of the storage capacitor is arranged on one side, away from the base substrate, of the gate of the driving transistor; and the second conductive portion and the second electrode of the storage capacitor are arranged on a same layer and insulated.

6. The display panel according to claim 1, wherein the display panel further comprises:

a plurality of light emitting control signal lines; and a first power line;

wherein each row of sub-pixels corresponds to one of the light emitting control signal lines; and the pixel circuit further comprises:

a light emitting control transistor;

wherein a gate of the light emitting control transistor is electrically connected with a corresponding light emitting control signal line, a first pole of the light emitting control transistor is electrically connected with the first power line, and a second pole of the light emitting control transistor is electrically connected with a first pole of the driving transistor.

7. The display panel according to claim 6, wherein the fixed voltage signal end is electrically connected with the first power line.

8. The display panel according to claim 7, wherein the first power line and the data line are arranged on a same layer and insulated, and the conductive portion and the first power line are arranged on different layers and insulated.

9. The display panel according to claim 6, wherein for the scanning signal lines and the light emitting control signal lines corresponding to the same row of the sub-pixels, conductive portions are arranged between the scanning signal lines and the light emitting control signal lines in a direction perpendicular to a plane where the display panel is arranged.

10. The display panel according to claim 1, wherein the display panel further comprises: a plurality of reset signal lines and an initialization signal line; and each row of the sub-pixels corresponds to one of the reset signal lines; and the pixel circuit further comprises a reset transistor, wherein a gate of the reset transistor is electrically connected with the corresponding reset signal line, a first pole of the reset transistor is electrically connected with the initialization signal line, and a second pole of the reset transistor is electrically connected with a second pole of the driving transistor.

11. The display panel according to claim 10, wherein the fixed voltage signal end is electrically connected with the initialization signal line.

12. A display device, comprising: the display panel according to claim 1.

* * * * *